United States Patent [19]

Gallimore

[11] 4,406,074

[45] Sep. 27, 1983

[54] HANGER CLIP FOR LEAFLETS AND THE LIKE

[76] Inventor: Claris G. Gallimore, 220 Lake Ave., Lake Villa, Ill. 60046

[21] Appl. No.: 869,473

[22] Filed: Jan. 16, 1978

[51] Int. Cl.[3] ..... G09F 3/18

[52] U.S. Cl. ..... 40/10 R; 40/121

[58] Field of Search ..... 40/10 R, 11, 11 A, 12, 40/122, 121

[56] References Cited

U.S. PATENT DOCUMENTS 2,829,454 4/1958 Mosiman ..... 40/12
2,850,820 9/1958 Lersch ..... 40/10 R
3,015,177 1/1962 Hembd ..... 40/10 R

FOREIGN PATENT DOCUMENTS 420830 3/1967 Switzerland ..... 40/11 A

*Primary Examiner*—Gene Mancene
*Assistant Examiner*—Wenceslao J. Contreras
*Attorney, Agent, or Firm*—Edmond T. Patnaude

[57] ABSTRACT

A unitary wire clip has a circular loop for receipt in a price rail channel, an overlapping portion for clamping the clip to the rail and a depending hook portion adapted to extend through aligned apertures in a plurality of leaflets, pamphlets or the like so that the leaflets hang below the price rail.

2 Claims, 8 Drawing Figures

HANGER CLIP FOR LEAFLETS AND THE LIKE

The present invention relates in general to clips for hanging leaflets or the like in retail establishments to permit removal of the leaflets by the customers, and it relates in particular to a new and improved clip which is adapted to be mounted to a conventional price rail or to be mounted on the front of a box or tray or to be mounted to upstanding counter or floor displays.

BACKGROUND OF THE INVENTION

It is a common practice in the marketing of prepared foods, toiletries, over-the-counter medicines and many other retail products to place give away informational leaflets in proximity to the product display. For example, in the case of food products, point of purchase recipe leaflets are frequently made available to the customer. The present invention enables the use of a single inexpensive clip for hanging such leaflets in proximity to the display of the associated product, the same clip being suitable for attachment to conventional price rails mounted to the front edges of display shelves, to open top boxes or trays in which products are displayed and on the front of the panels of upstanding floor and counter displays.

SUMMARY OF THE INVENTION

Briefly, there is provided in accordance with the present invention a novel hanger clip having a partially overlapping single turn loop of resilient wire and a hanger portion which depends outwardly and forwardly of the loop with an upstanding end to hold the leaflets on the hanger portion. When used in a price rail channel the loop is placed in the channel behind the forward lips with the overlapping portion resiliently clamped to the lower lip to hold the clip in place with the hanger depending below the price rail so that the leaflets do not obscure pricing information contained in the rail.

GENERAL DESCRIPTION OF THE DRAWING

The present invention will be better understood by a reading of the following detailed description taken in connection with the accompanying drawing wherein.

DETAILED DESCRIPTION OF THE INVENTION

Figure 1:
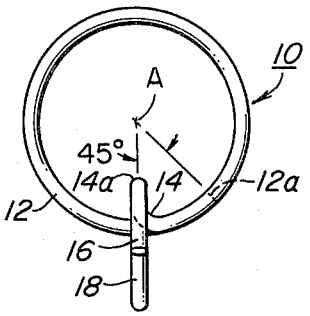
FIG. 1 is a front elevation of a hanger clip embodying the invention.
Figure 2:
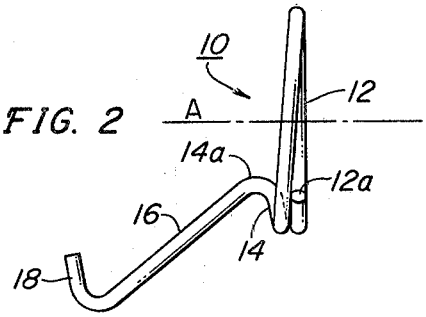
FIG. 2 is an elevation taken from the right hand side of the clip as shown in FIG. 1.

Referring particularly to FIGS. 1 and 2, a hanger clip 10 embodying the present invention is formed of a single length of resilient wire with one end portion thereof formed into a single turn loop 12 with an overlapping portion of about forty-five degrees. Preferably the loop portion 12 has an external diameter of approximately one and one-eighth inch so as to fit in a standard size price rail in the manner described hereinafter in connection with FIGS. 3 and 4. As best shown in FIG. 2, the overlapping portions of the loop are substantially juxtaposed.

Immediately adjacent to the loop portion of the clip there is a first intermediate portion 14 which extends radially toward the central axis A of the loop 12. The top most surface of the portion 14 is rounded and identified at 14*a* and is at about the same height as the end 12*a* of the loop portion 12. Adjacent the portion 14 is a second intermediate portion 16 which slants downwardly away from the loop and terminates in an upstanding end portion. The portions 14, 16 and 18 lie in a common plane which also includes the vertical diameter of the loop 12. The length of the portion 16 is not critical but is preferably sufficiently long so that the top edges of the leaflets hung thereon are below top surface 14*a*.

Figure 3:
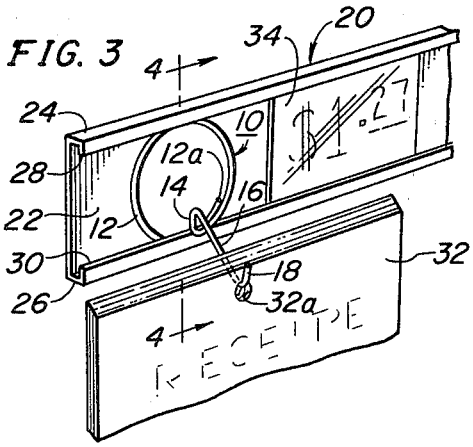
FIG. 3 is a pictorial view showing the clip of FIG. 1 in use on a price rail.
Figure 4:
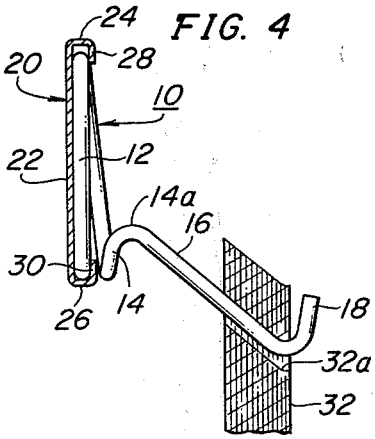
FIG. 4 is a sectional view taken along the line 4—4 of FIG. 3.

Referring to FIG. 3, the clip 10 is shown in use in a price rail 20 of channel shaped construction. The rail 20 includes a web 22, upper and lower flanges 24 and 26 and upper and lower reentrant lips 28 and 30. The external diameter of the loop portion 12 is greater than the distance between the lips 28 and 30, but less than the distance between the lower side of the flange 24 and the upper edge of the lip 30 to permit insertion of the clip into the channel. The lip 30 is clamped between the overlapping portions of the loop 12 to prevent spurious movement of the clip in the rail. A stack of leaflets or pamphlets 32 each having an aperture 32*a* near the top are hung on the clip 10 with the intermediate hanger portion 16 extending through the apertures 32*a*. It may be seen from FIG. 1 that the top edges of the leaflets 32 are below the price rail 20 so as not to obscure price information 34 contained in the price rail.

Figure 5:
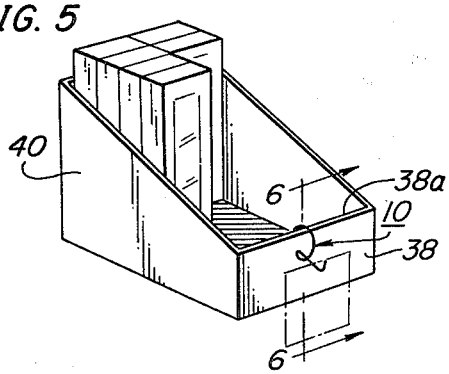
FIG. 5 is a pictorial view showing the clip of FIG. 1 in use on a display tray.

Referring to FIG. 5 the clip 10 is fitted over the upper edge of a front panel 38 on a display tray 40 with the upper edge 38*a* of the front panel engaging the inner side of the loop portion 12. The overlapping portions of the loop prevent the clip from twisting on the panel about a vertical axis.

Figure 6:
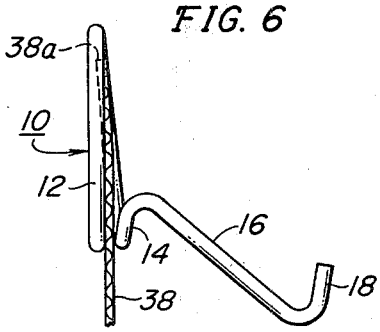
FIG. 6 is a sectional view taken along the line 6—6 of FIG. 5.
Figure 7:
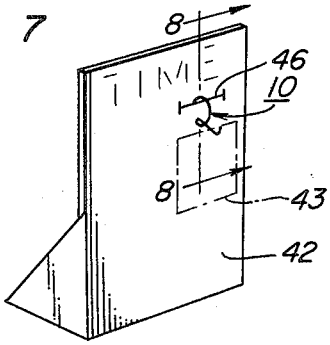
FIG. 7 is a pictorial view showing the clip of FIG. 1 in use on an upstanding display panel.
Figure 8:
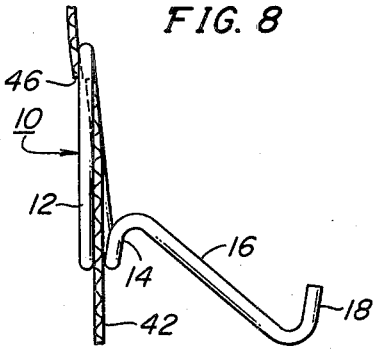
FIG. 8 is a sectional view taken along the line 8—8 of FIG. 7.

Referring to FIG. 7, the hanger clip 10 is shown mounted to the face of an upstanding display panel 42. A plurality of leaflets 43 are hung on the hanger portion of the clip. In order to mount the clip to an intermediate location on the face of the panel, a horizontal slit 46 is cut in the panel a short distance above the desired location of the leaflets 43. The loop portion is then sprung apart, and inserted into the slot 46 with the overlapping portions of the loop on opposite sides of the panel. The clip 10 is thus secured to the panel 42 in essentially the same way it is attached to the tray panel 38 in the embodiment of FIGS. 5 and 6.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. In combination a price rail in the form of a C-shaped channel member having a verticle web portion horizontal flanges and upper and lower reentrant vertical lips on the outer ends of said flanges, and a hanger clip for holding a plurality of paper leaflets or the like, said leaflets having aligned apertures therein, comprising a single length of resilient wire having one end portion thereof formed into a partially overlapping single turn loop, a first intermediate portion of said wire lying immediately adjacent said one end portion and extending in a substantially radical direction towards the axis of said loop.

2. In the combination according to claim 1, a portion of said loop being positioned between said upper one of said lips and said web portion to maintain said loop in a vertical plane.

* * * * *